US006408466B1

(12) United States Patent
Blotta

(10) Patent No.: US 6,408,466 B1
(45) Date of Patent: Jun. 25, 2002

(54) STRETCHER FOR THE NON-TRAUMATIC TRANSPORT AND LIFTING OF PEOPLE

(76) Inventor: Claudio Artemio Blotta, Chacabuco 96, 2° piso, 1069 - Buenos Aires (AR)

( * ) Notice: Subject to any disclaimer, the term of this patent is extended or adjusted under 35 U.S.C. 154(b) by 0 days.

(21) Appl. No.: 09/544,784

(22) Filed: Apr. 7, 2000

(30) Foreign Application Priority Data

Apr. 9, 1999 (AR) ..... P 99 01 01622

(51) Int. Cl.[7] ..... A61G 1/003
(52) U.S. Cl. ..... 5/625; 5/81.1 HS; 5/81.1 C
(58) Field of Search ..... 5/81.1 C, 81.1 HS, 5/625, 626

(56) References Cited

U.S. PATENT DOCUMENTS 3,418,670 A * 12/1968 Morgan ..... 5/81.1 C
3,654,644 A * 4/1972 Stevens ..... 5/81.1 C
3,724,005 A * 4/1973 Stevens ..... 5/81.1 C
3,760,435 A * 9/1973 Jardine ..... 5/81.1 C
3,781,929 A * 1/1974 Stevens ..... 5/81.1 C
4,156,946 A * 6/1979 Attenburrow ..... 5/81.1 C
4,679,259 A * 7/1987 DiMatteo et al. ..... 5/81.1 C

FOREIGN PATENT DOCUMENTS

GB 000023954 A * of 1910 ..... 5/81.1 C

* cited by examiner

*Primary Examiner*—Michael F. Trettel
(74) *Attorney, Agent, or Firm*—Pendorf & Cutliff

(57) ABSTRACT

A stretcher for the non-traumatic transport and lifting of people including a frame with a pair of longitudinal beams that each have a toothed bars. Further, included is a plate positioned between the frame, the plate has a flexible sheet placed completely around the plate. The flexible sheet is retained around the plate by a piece that is fixed to a base that is positioned over the frame. Contained within the base is a driving axle that has dented wheels that correspond to the tooth bars of the frame. The rotation of the driving axle moves the dented wheels which will move the tooth bars and causes the base to move the inclined plate with the flexible sheet.

7 Claims, 3 Drawing Sheets

STRETCHER FOR THE NON-TRAUMATIC TRANSPORT AND LIFTING OF PEOPLE

BACKGROUND OF THE INVENTION

1. Field of Invention

Figure 1:
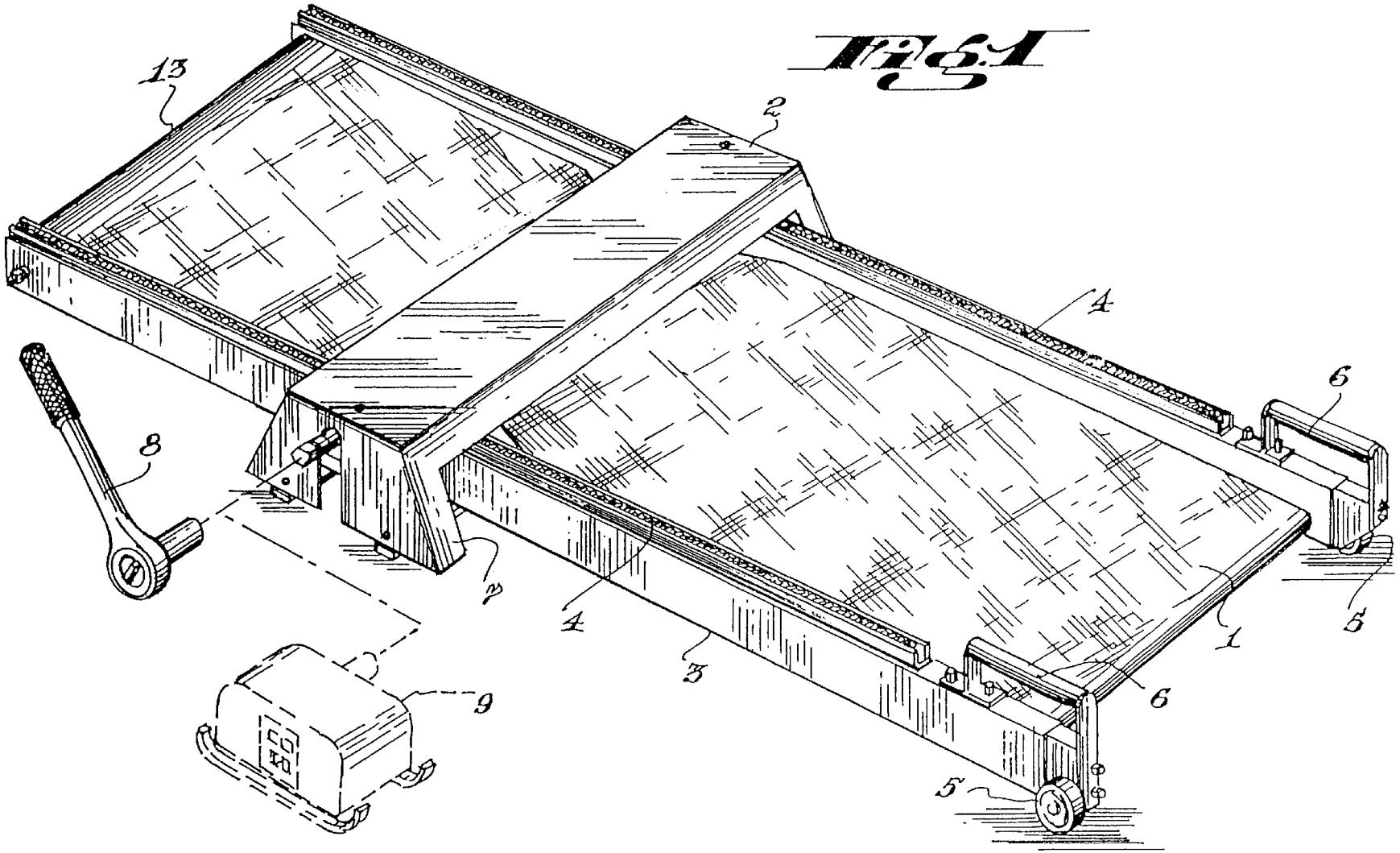

The invention relates to a stretcher, and more particularly to a stretcher to lift and transport patients that are lying on an irregular surface and that have to be lifted and transported with the least possible trauma.

This type of stretcher is useful for patients that are in very serious condition and should not be lifted to be put on the stretcher.

The stretcher of the present invention is particularly useful in those situations in which people injured in car accidents remain lying on the ground with traumatisms that make necessary to move them to an ambulance, without changing their position so as not to aggravate their condition.

2. Description of Related Art

Devices for the transfer of patients, by using conveyor belts that are introduced under the body of the patient, to avoid the transfer are taught in U.S. Pat. No. 3,493,979.

In the patent set out above there are two superposed continuous conveyor belts. The conveyor belts surround separators, which are retractile plates shaped.

Another type of stretcher is the one disclosed in U.S. Pat. No. 4,077,073, by the same inventor, in which a new feature is added to improve the previous invention. The improvement is the addition of lever bars to adjust the distance between the rolls that drive the continuous conveyor belt.

Furthermore, the U.S. Pat. No. 4,680,818 discloses a device to move lying down persons by means of two belts rollable around two rolls and two extensible plane plates. The plates are horizontally retractable on the surrounding belts.

The advantage of the stretcher of the present invention is the simplicity of its mechanism in comparison with the already known ones. Its essential difference is that the flexible band or sheet does not have any movement at all, but the slightly inclined plate has it.

SUMMARY OF THE INVENTION

The main object of the invention is a stretcher that lifts the patient on to the stretcher from a plane surface and is then used to move the patient to his transportation. The novelty of the invention is that it consist of a frame including both longitudinal beams among which there is a slightly inclined plate. The plate is surrounded by a flexible sheet that can slide on the plate and on both longitudinal beams. Along the longitudinal beams there are a series of recesses in which the teeth of each dented wheels penetrate. The dented wheels pertaining to a rotating axis, its ends are joined to a bow-shaped base with legs that support the stretcher. The flexible sheet is fixed to the base. An end of the rotating axis, which has a driving means, projects at the side of the base.

In a preferred embodiment of the invention, at the end of the longitudinal beams corresponding to the lower end of the sheet there are wheels for the movement of the stretcher.

In the preferred embodiment of the invention, at the end of the longitudinal beams corresponding to the lowest end of the sheet there are each leading edges conformed in such a way that when they are moved on irregular ground the longitudinal beams drive themselves as, when they are in contact with the ground as gliders (for example, a sledge)

In the preferred embodiment of the invention, the driving means at the end of the axle are a coupling for a ratchet that has a lifting mechanism that allows it to make the axle rotate.

In said preferred embodiment of the invention, the driving mean at the end of the axle is a coupling to a speed reducer coupled to a driving motor.

In the above embodiment of the invention, the ends of the flexible sheet are joined by means of a part which, simultaneously is fixed to the base.

BRIEF DESCRIPTION OF TH DRAWINGS

Figure 2:
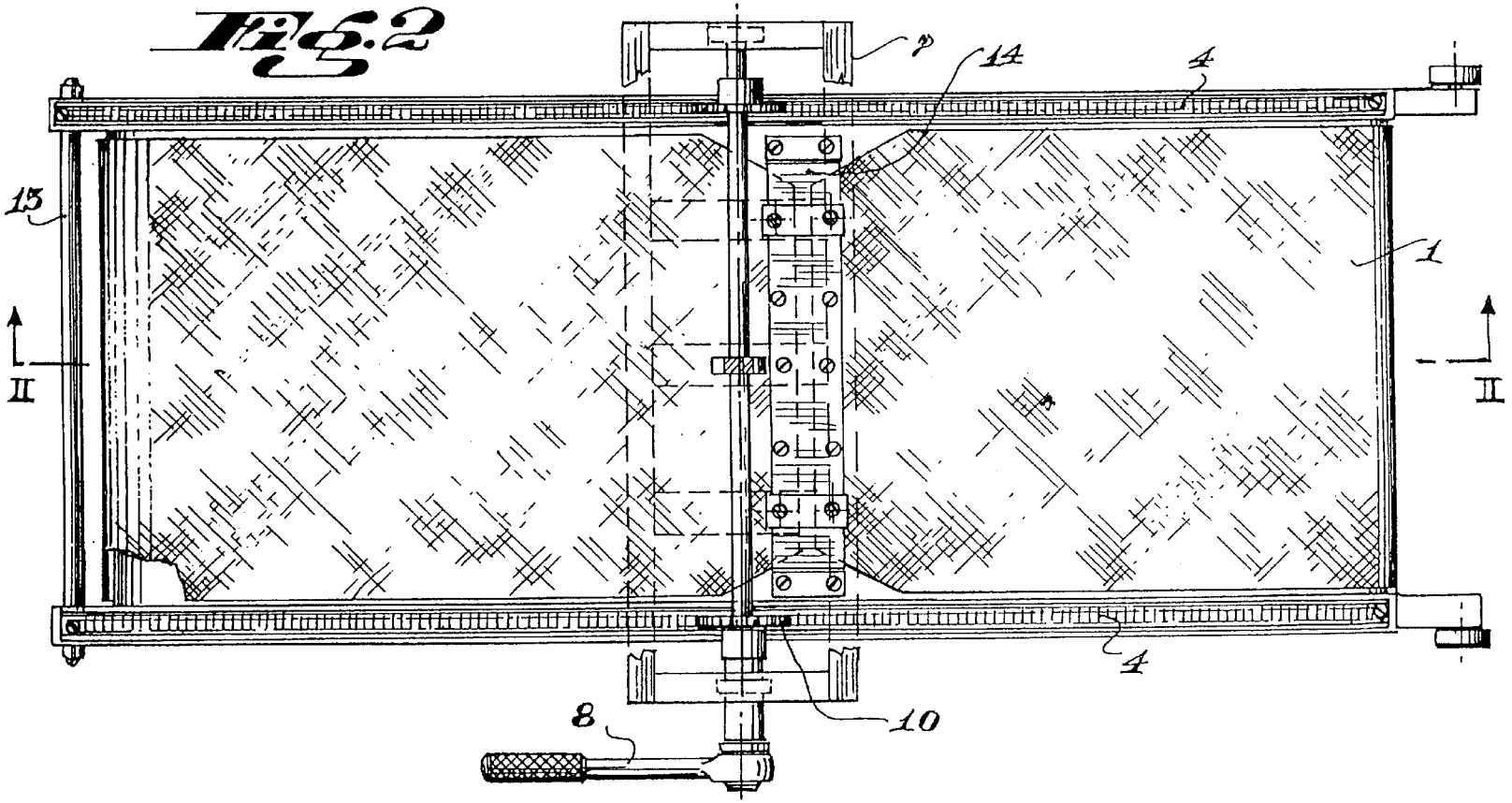
Figure 3:
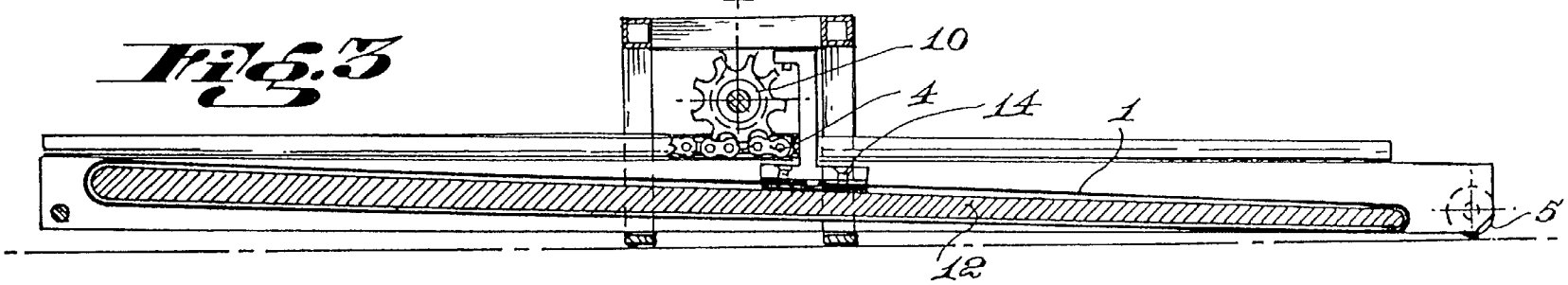

These and other features of the invention will be described with reference to the following specification. In the specification, the figures the following:

FIG. 1, a view in perspective of the stretcher according to the invention,

FIG. 2, a top view of the superior part of the stretcher,

FIG. 3, view of a part drawn in the line II—II in FIG. 2, and

Figure 4:
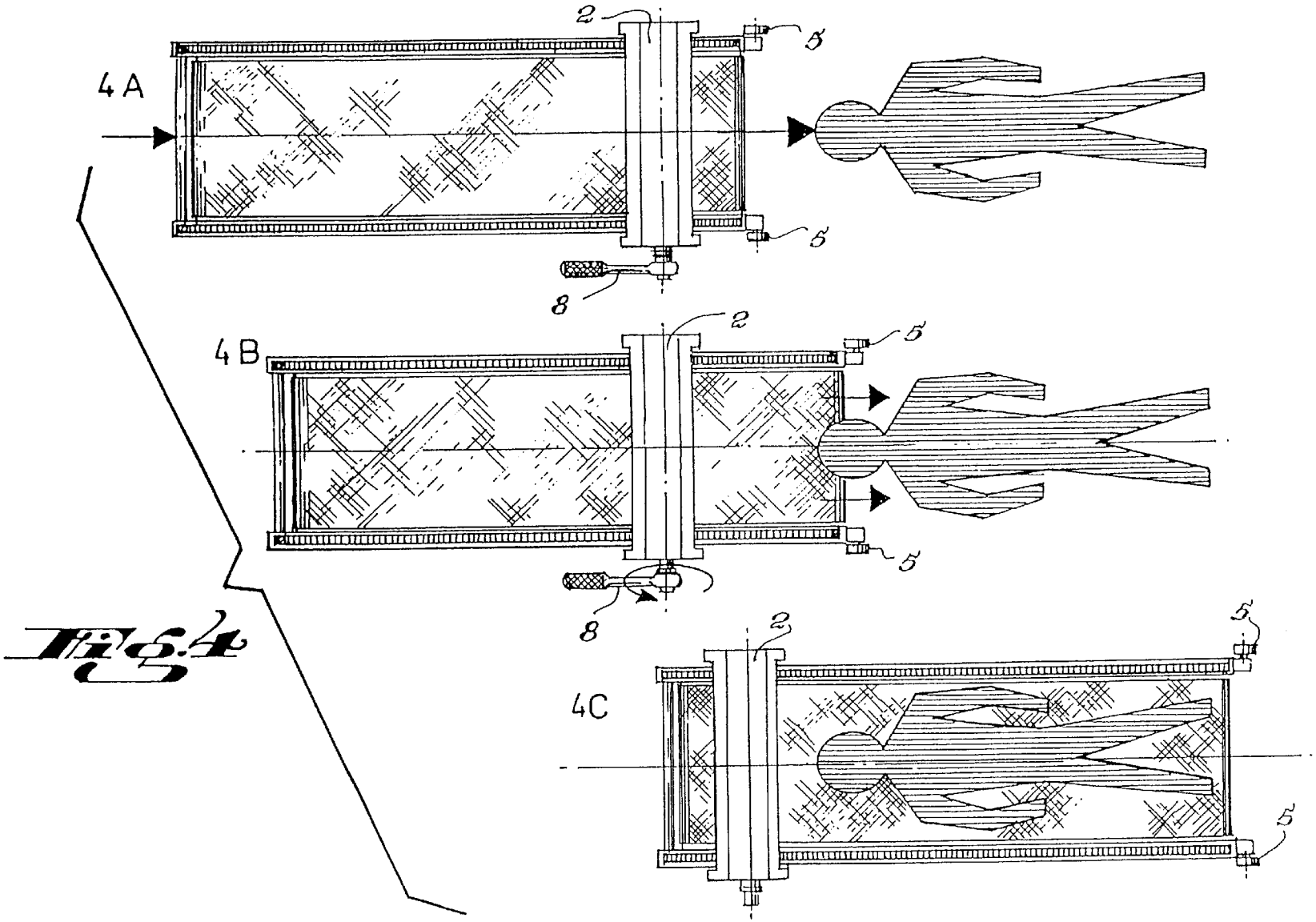

FIG. 4, describe three different moments during the use of the stretcher of the invention.

DETAILED DESCRIPTION OF THE INVENTION

In the figures it can be observed that the stretcher includes a flexible sheet 1 surrounding the plate 12, and having one of its ends in a lower position in relation to the other end. The sheet 1 is fixed between a frame 3, made of two longitudinal beams, each beam having at its superior edge a toothed bar 4 on which the corresponding dented wheels 10 work, and are mounted on an axle supported by the base 2.

The base 2, which surrounds the set of frames, and is at the same time is supported by [means of] the legs 7. The support sets the position of the stretcher on the plane surface on which it is placed.

Furthermore, the piece 14 that joins the ends of the flexible sheet 1 is fixed to the base 2.

One of the ends of a driving axle projects through the side of the base and has a coupling for a detachable ratchet 8. The ratchet has a lifting mechanism that rotates the axle. Alternatively the ends of the axle may be coupled with a set of motor and reducer.

At one end of the frame, corresponding to the lowest point of the sheet 12, and in the inferior part, there are wheels 5. The wheels 5, together with the legs 7 constitute the support of the stretcher when it is used. They are also useful for the transportation of the stretcher when it is lifted by the bar 13.

In the same end in which the wheels 5 are found, the handles 6 can be found. The handles 7 are used to lift this end when the patient must to be transported.

The way in which the stretcher may be used can be seen in FIGS. 4*a* 4*b* and 4*c*, in which a person lies on a plane surface. In FIG. 4*a*, the stretcher is drawn near the person in the direction of the arrow with the base 2 in the position nearest the end corresponding to the wheels 5, letting the legs 7 rest on the ground.

Then, by using a ratchet 8 the driving axle of the dented wheels 10 is rotated, see FIG. 4*b*. The Said dented wheels 10, are engaged to the toothed bars 4, and move the frames 3 in the direction of the arrows and towards the patient.

Due to the fact that the ends of the flexible sheets 1 are fixed to the base 2, when the frames 3 move forward, the superior part of the flexible sheet 1 remains in the same position with reference to the surface where the stretcher lies. Consequently, the end of plate 12 is introduced between the patient and the surface on which the patient lies on without any kind friction, nor sudden movements, since the end of the sheet 1 is very close to the surface where the patient lies.

Then, the ratchet 8 is rotated up to the base 2 that is at the other end of the stretcher and the patient is completely on the stretcher, see 4*c*. After taking off the ratchet 8, the stretcher is held by the bar 13 and by the handles 6 in order to transport the patient.

Alternatively, instead of using the ratchet 8, is the couple to the axle an electrical motor 9 with its corresponding redactor. The motor lies on the same surface where the stretcher lies on and it is activated and deactivated with a switch.

What is claimed is:

1. A stretcher that lifts the patient on to the stretcher from a plane surface and capable of being used to carry the patient to transportation, the stretcher comprising;

a frame having longitudinal beams with an inclined plate therebetween;

a flexible sheet positioned about the inclined plate, the flexible sheet having ends positioned in a lower position of said plate;

a bow-shaped base which surrounds the longitudinal beams of the frame, the bow-shaped base having legs that provide support;

a piece fixed to the base for joining each end of the flexible sheet at the lower position and allowing the flexible sheet to slide as the plate is moved along by the longitudinal beams;

a driving axle projecting through a side of the base; the driving axle having a coupling for receiving a means for rotating the axle; and said longitudinal beams each having a superior edge with a toothed bar to receive dented wheels that are mounted onto the drive axle within the base, the means for rotating the drive axle is capable of causing the dented wheels to engage the toothed bars to move the base and in turn move the flexible sheet.

2. The stretcher as set forth in claim 1, wherein wheels for the movement of the stretcher are positioned at the end of the longitudinal beams that correspond to the lower end of the sheet.

3. The stretcher as set forth in claim 1, wherein the longitudinal beams are lateral to the flexible sheet.

4. The stretcher as set forth in claim 1, wherein a driving axle has a coupling for receiving the means to rotate the driving axle.

5. The stretcher as set forth in claim 4, wherein the coupling is for a ratchet, and the ratchet is the means for rotating the driving axle.

6. The stretcher as set forth in claim 4, wherein the coupling is for a speed reducer and the means for rotating the driving axle is a motor coupled with the speed reducer.

7. The stretcher as set forth in claim 1, wherein wheels and a pair of handles are included at one end of the frame while a bar is located at another end of the frame.

* * * * *